United States Patent [19]

Grandi

[11] 4,104,857

[45] Aug. 8, 1978

[54] SPINNING AND TWISTING DEVICE

[75] Inventor: Giorgio Adolfo Grandi, Bologna, Italy

[73] Assignee: Fratelli Marzoli & C. S.p.A., Palazzolo S Oglio (Brescia), Italy

[21] Appl. No.: 799,856

[22] Filed: May 23, 1977

[30] Foreign Application Priority Data

Jun. 3, 1976 [IT] Italy ..... 3456 A/76

[51] Int. Cl.[2] ..... D01H 7/58

[52] U.S. Cl. ..... 57/124; 57/75; 57/100; 57/119

[58] Field of Search ..... 57/1 R, 34 R, 75, 100, 57/112, 119, 122, 124, 129

[56] References Cited

U.S. PATENT DOCUMENTS

| | | | |
|---|---|---|---|
| 3,543,503 | 12/1970 | Watabe et al. | 57/124 X |
| 3,785,140 | 1/1974 | Muller | 57/100 |
| 3,851,448 | 12/1974 | Sano et al. | 57/124 X |
| 4,023,342 | 5/1977 | Schenkel | 57/124 X |

*Primary Examiner*—Donald Watkins
*Attorney, Agent, or Firm*—Karl W. Flocks

[57] ABSTRACT

This invention relates to a spinning and twisting device designed for fitting to the ring support carriage of continuous spinning and twisting machines, the so-called ring spinners, as a replacement for the traditional ring slider devices on the said carriage. The device according to the invention comprises an annular stator member, an annular rotor member rotatably coupled to said stator in such a way as to be axially aligned therewith and with the relative spindle of said machine, and provided with a passage for the thread being worked, which rotates it, and braking means disposed between the stator member and rotor member.

7 Claims, 2 Drawing Figures

SPINNING AND TWISTING DEVICE

This invention relates to a spinning and twisting device designed for fitting to the ring support carriage of continuous spinning and twisting machines, the so-called ring spinners, as a replacement for the traditional ring slider devices on the said carriage.

With the traditional ring sliders now used in spinning and twisting, the operation speed and thus the speed of rotation of the spindles attainable on ring spinners is notably limited as the braking action of the slider, necessary to keep the thread taut, depends on the high specific pressure which the slider exerts on the inner edge of the ring.

This high pressure, which is strictly related to the centrifugal force acting on the slider and thus to the operating speed of the ring spinner, is the reason for rapid slider wear. Frequent manual intervention is thus necessary to replace the worn sliders, with frequent interruptions in operation.

Moreover, because of its small mass and its high friction against the ring, the temperature of the slider dragged by the thread rises to a high level, and thus threads sensitive to heat cannot be worked.

A further disadvantage of the traditional ring slider device is the fact that a ring of any given diameter is suitable only for working a narrow range of threads. Hence if the count (thread weight) has to be changed to such an extent that it leaves the range of any given ring, it is necessary to replace not only the sliders but all the rings on the carriage of the ring spinner.

The purpose of the device according to the invention is to obviate the stated drawbacks of ring spinners, and at the same time to attain the following main objects:

To allow the rotational speed of the spindles to be considerably increased, with corresponding high production;

To considerably reduce manual intervention when replacing worn members;

To enable heat sensitive threads to be worked;

To embrace with a single type of device the entire range of threads, from the lightest to the heaviest, of whatever quality.

These and further objects which will be more evident hereinafter are all attained by the present spinning and twisting device for fitting to the ring support carriage of ring spinners as a replacement for the ring slider devices, comprising an annular stator member, an annular rotor member rotatably coupled to said stator in a manner axially aligned therewith and with the relative spindle of said machine, and provided with a passage for the thread being worked, which rotates it, and breaking means disposed between the stator member and rotor member.

Advantageously said braking means consist of blades connected to said rotor member and acting frictionally against said stator member.

In particular each of said blades terminates in a hook on the inside of said rotor member, and on the outside thereof it is designed to act frictionally by its lower face against a top surface of said stator, said surface being at a higher level than that of the region in which said hook presses by centrifugal force against the inner surface of said rotor. The apertures for inserting and hooking the blades to said rotor member are provided in the member in diametrically opposite positions.

The device according to the invention thus possesses the following characteristics: it utilizes a braking action adjustable at will to the required value and, even though high, results from a low specific pressure; it transmits this action to rotating parts which are perfectly dynamically balanced; it generates the said braking action by means which prevent the thread from coming into direct contact with high temperature regions.

Further characteristics and advantages of the invention will be more evident from the description of a preferred but not exclusive embodiment of the device according to the invention, illustrated by non-limiting example in the accompanying drawing in which.

Figure 1:
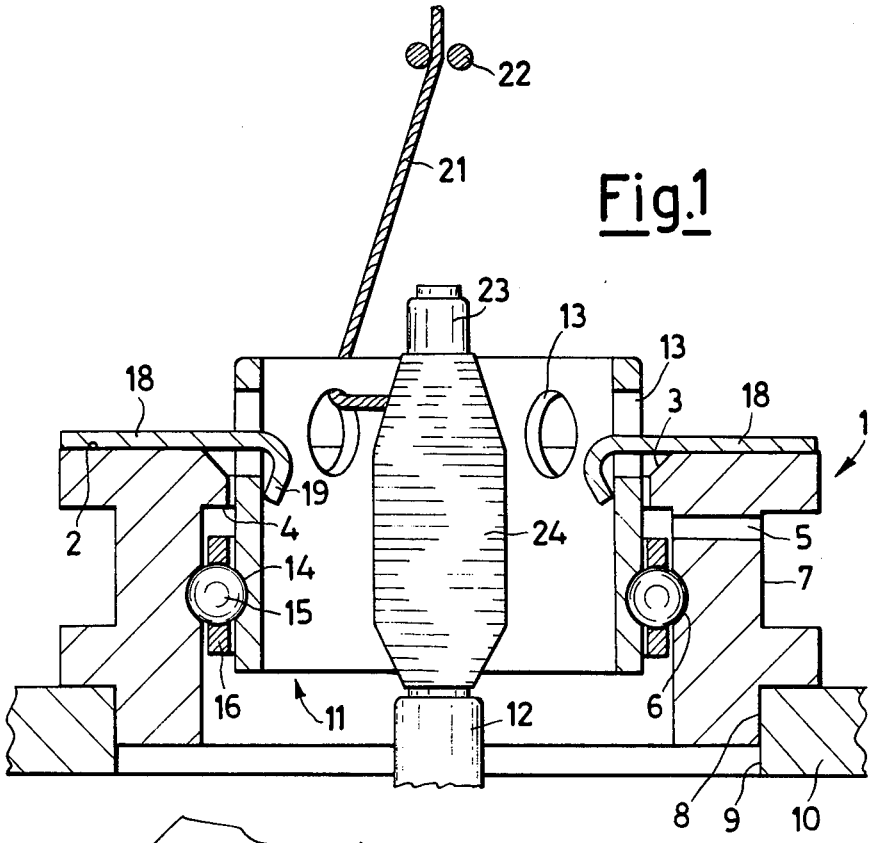
FIG. 1 is a vertical section through the device according to the invention, on a plane passing through the axis of the respective spindle.
Figure 2:
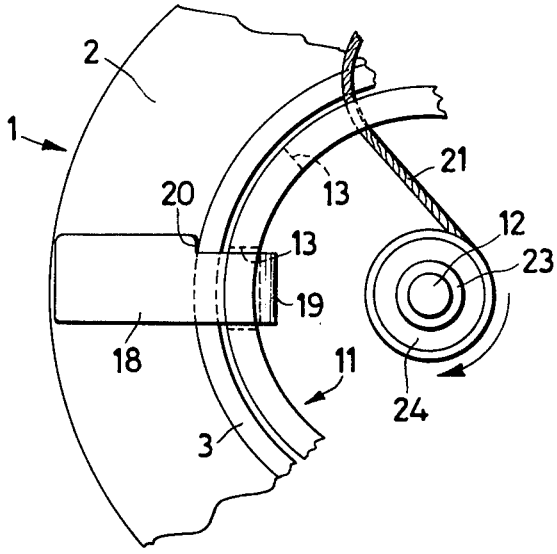
FIG. 2 is a plan view of part of said device.

With reference to these figures, the device according to the invention comprises the annular stator member 1 of a certain height, the stator 1 defining at its summit a large horizontal region 2 of circular rim shape. Starting from the said rim region 2, the inner surface of the stator 1 firstly comprises a flared portion 3 and then, after the step 4, it increases in diameter and continues cylindrically downwards. Immediately below the step 4, through lubricating bores 5 open into the stator 1. An annular groove 6 is provided on the inner surface of the stator 1 below these bores. On the outer surface of the stator 1 there is a wide annular channel 7 and then, at the lower end of the stator, the step 8 for supporting and centering the stator in the corresponding bore 9 in the carriage 10 of the ring spinner.

In traditional ring spinners, the respective ring slider devices are fitted to the bores 9. The stator 1 is locked to the carriage 10 in known manner by screw means using the channel 7.

Into each stator 1 there is inserted a respective annular rotor member 11 which projects above the rim 2 and is coaxial with the stator and the relative spindle 12. At each projecting region, the cylindrical rotor 11 is traversed in diametrically opposite positions by apertures 13. In proximity to its lower end, the rotor 11 is provided externally with the annular groove 14 opposing the groove 6 in the stator. Spherical rolling members 15 are disposed in the two opposing grooves 6 and 14 between the rotor and stator to rotatably connect the one to the other. The spheres 15 are kept at the required distance apart circumferentially by the annular cage 16. It should be noted that in order to facilitate drawing, the stator 1 and rotor 11 are shown in the figures much larger than they are in practice and are not in proportion to the spindle 12, which in fact is shown smaller than its true size.

The apertures 13 are designed for receiving respective blades 18 constituted by a small portion of flat metal strip. At one end, each blade is bent to form a respective hook 19. At the hook and in proximity thereto, the blade is narrower than the remaining region, so as to define the step 20 on one side of the blade. This region of the blade is wider than the aperture 13. The two blades of a pair are inserted into two respective diametrically opposing apertures 13, in which they are free to swivel vertically while remaining radial. Each blade 18 is inserted from the outside of the rotor 11 in a downward direction, with its hook 19 facing upwards. When the hook 19 has been inserted into the centre of the relative aperture 13, the blade is rotated through one half of a turn. In this manner, the wider region of the blade rests on the rim 2, and the hook 19 engages with the inner surface of the rotor 11 below the aperture 13, at a level lower than the level of the rim 2, this latter being a desired condition. As the blade 18 is retained by the step 20, it is unable to pass completely into the rotor 11 and fall.

The thread 21 from the feed rollers, not shown, now descends through the eye 22 disposed above the spindle 12 and on the same axis thereof. As it descends further, the thread traverses a passage in the rotor 11, constituted for example by one of the apertures 13 not containing a blade, and then reaches the tube 23 mounted on the spindle 12. The cop 24 is formed on the tube 23 in known manner. On operating the ring spinner modified in this manner and rotating the spindle 12, the thread 21 rotates the rotor 11 and the braking blades 18 therewith. The rotor, which is in perfect dynamic equilibrium, supports a large part of the centrifugal force to which the blades 18 are subjected, in that the hook 19 thereof presses against the inner surface of the rotor. Because of the difference in level between the hook 19 and rim 2, the outer region of the blades presses from the top downwards on the rim due to the remaining part of the centrifugal force, and slides on the rim with a large surface of contact, to brake the rotor. The level of force exerted by the blades 18 on the rim 2 may be kept constructionally as low as required, providing that by means of a suitable length of hook 19 an appropriate difference in level is established between the rim 2 and the region in which the hooks press against the inner surface of the rotor 11. Because of the large surface of contact between the blades and rim (and which can be made as large as required) the specific pressure exerted by the blades 18 on the rim 2 is minimal. With the rotor perfectly balanced dynamically, and with the minimum specific pressure exerted by the blades on the rim 2, the device according to the invention has a very long life and enables the spindles to reach speeds of rotation which up to the present time have been considered unobtainable. The number of blades to be inserted into the rotor 11 evidently varies according to the quality, count and breaking load of the thread to be worked. In this respect, the braking action of the blades determines the tension in the thread. Thus to work light or weak threads, few pairs of blades are sufficient, while for heavier threads, a larger number of pairs of blades are inserted into the rotor 11. The thread does not come into contact with high temperature regions.

The invention so conceived attains the stated objects.

It is susceptible to numerous modifications and variations all of which fall within the inventive concept. Thus instead of the stator 1 offering the circular rim 2 perpendicular to the axis of the spindle 12 for contact with the blades 18, it can offer an internal lateral cylindrical surface, with the blades hooked to the rotor 11 acting with friction against said surface. Any type of blade falls within the scope of the inventive concept providing it hooks on to the rotor 11 to discharge thereon a large proportion of the centrifugal force to which it is subjected, and to act frictionally on the stator 1. All details may be replaced by others technically equivalent. In practice, the materials used and the shapes and dimensions may be chosen at will according to requirements.

What we claim is:

1. A spinning and twisting device for fitting to the ring support carriage of ring spinners as a replacement for the ring slider devices, comprising an annular stator member, an annular rotor member rotatably coupled to said stator in a manner axially aligned therewith and with the relative spindle of said machine, and provided with a passage for the thread being worked, which rotates it, and braking means disposed between said stator member and said rotor member, said braking means including blades hooked to said rotor member and acting frictionally against said stator member by the effect of the centrifugal force acting on them, part of the centrifugal force being supported by said rotor member at the region in which said blades are hooked thereto.

2. A device as claimed in claim 1, wherein said rotor member is rotatably coupled to said stator member by way of rolling members.

3. A device as claimed in claim 1, wherein said rotor member is internal to said stator member.

4. A device as claimed in claim 1, wherein, for hooking to said rotor member, said blades are each provided with a hook insertable by rotation.

5. A device as claimed in claim 1, wherein each of said blades terminates in a hook inside said rotor member, and outside this latter it is designed to act frictionally by its lower face on a top surface of said stator member, said surface being at a higher level than that of the region in which said hook presses against the inner surface of said rotor by centrifugal force.

6. A device as claimed in claim 2, wherein said rotor member comprises diametrically opposing apertures for inserting and hooking respective said blades, these apertures being disposed above said rolling members.

7. A device as claimed in claim 6, wherein that part of each of said blades external to said rotor member is wider than its internal part provided with the said hook, and also wider than said insertion and hooking aperture.

* * * * *